US006153862A

United States Patent [19]

Job

[11] Patent Number: 6,153,862

[45] Date of Patent: Nov. 28, 2000

[54] FABRIC DRYER/WARMER

[76] Inventor: Donald D. Job, 393 Beacon St., Lowell, Mass. 01850

[21] Appl. No.: 09/258,506

[22] Filed: Feb. 26, 1999

[51] Int. Cl.[7] ..... H05B 3/06

[52] U.S. Cl. ..... 219/521; 219/385; 392/416

[58] Field of Search ..... 219/386, 385, 219/345, 521, 528, 438; 392/382, 416; 34/46, 163, 68, 45, 97, 98; 248/463, 472, 470, 471, 126; 296/65.03

[56] References Cited

U.S. PATENT DOCUMENTS

| | | | |
|---|---|---|---|
| D. 315,432 | 3/1991 | Smith | D32/58 |
| 3,160,482 | 12/1964 | Foote | 34/665 |
| 3,576,079 | 4/1971 | Hauser | 34/542 |
| 3,626,152 | 12/1971 | Governale et al. | 392/416 |
| 3,849,629 | 11/1974 | Graham | 219/385 |
| 4,117,309 | 9/1978 | Cayley | 219/385 |
| 4,485,297 | 11/1984 | Grise | 219/528 |
| 4,559,442 | 12/1985 | Graham | 219/385 |
| 4,656,339 | 4/1987 | Grise | 219/528 |
| 4,760,243 | 7/1988 | Tedioli | 219/366 |
| 4,862,602 | 9/1989 | Krill | 34/239 |
| 4,918,290 | 4/1990 | DeMars | 219/400 |
| 4,927,995 | 5/1990 | Lovett | 219/385 |
| 4,947,026 | 8/1990 | Groom | 219/401 |
| 4,962,297 | 10/1990 | Lowenberg | 219/449 |
| 5,004,895 | 4/1991 | Nishino | 219/528 |
| 5,098,056 | 3/1992 | Alger et al. | 248/463 |
| 5,231,266 | 7/1993 | Warren | 219/521 |
| 5,642,462 | 6/1997 | Huff | 392/382 |
| 5,921,606 | 7/1999 | Moradell et al. | 296/65.03 |

*Primary Examiner*—Teresa Walberg
*Assistant Examiner*—Leonid Fastovsky

[57] ABSTRACT

This invention discloses a device to warm and/or dry textiles to enhance comfort and to prevent prolonged dampness in articles of clothing or towels which could promote growth of mold or mildew. Consistent use of the invention for towels in bathrooms should have a positive impact on indoor air quality.

19 Claims, 11 Drawing Sheets

FABRIC DRYER/WARMER

FIELD OF INVENTION

The invention relates to the drying and/or warming of towels and articles of clothing such as is found in bathrooms where molds and mildew occur. More specifically, the present invention relates to devices which will dry moist fabrics as towels and lingerie and will warm towels for use.

BACKGROUND

Several devices are being marketed as towel warmers or baby diaper warmers. Other devices are marketed as room heaters. Still other devices have been invented which are designed to provide warm towels as in health clubs. In some instances warm moist clothes are provided.

A number of devices have been proposed for warming towels, primarily as a comfort issue, rather than reducing mildew in the bathroom environment. U.S. Pat. No. 4,760,243 to Tedioli incorporated herein by reference, discloses a heater and drier for bathrooms that uses resistive heating elements and a blower fan. Floor mounting and wall mounting versions are disclosed. U.S. Pat. No. 4,117,309 by M. Cayley, incorporated herein by reference, discloses an electric towel warmer having heated plates over which towels are placed and a cover to retain heat. A similar design is disclosed in U.S. Pat. No. 4,927,995 by Lovett and Lovett which has a hinged cover and wall mounted heating chamber. A portable towel heating devices is disclosed in U.S. Pat. No. 4,918,290 by DeMars comprised of a cabinet having an internal blower-heater. U.S. Pat. No. 4,947,026 by Groom and Groom discloses a combination heating and moistening device for towels.

Bulky and/or fragile articles of clothing are often hand washed and/or hand dried. Conventional drying methods are too harsh and leave the articles misshapen, shrunk or snagged. Such clothing is often hand rinsed, rung out by hand and layed out on a towel or hung over a hanger, curtain rod, or clothesline to dry by convection. This is very inefficient and disruptive of space.

Sweater drying devices have been developed to address this need. For example a collapsible drying rack is disclosed in U.S. Pat. Design No. 315,432 by Smith and in U.S. Pat. No. 4,862,602 by Krill a drying frame is indicated. Most racks take up space, are bulky, and/or slow in action. There is therefore a need to provide a device and method for delivery of low, sustainable heat evenly over a surface large enough to spread out the articles of clothing as sweaters, towels, women's hosiery, lingerie, and the like. At the same time, such a device should be economical to produce and safe to operate.

There are a number of approaches to providing low sustained heat that are self-limiting so as to not present a fire hazard. One approach is to provide a temperature sensor external to the heating element and as part of a control loop as in U.S. Pat. No. 4,962,297 by Lowenberg. Another approach is to have the element itself of sufficiently high resistance so that current flow is limited. Such an approach is exemplified in U.S. Pat. No. 5,004,895 by Nishino et al. for their floor mat heater and in the sheet heaters developed by Grise of Flexwatt Corporation. Grise's U.S. Pat. Nos. 4,656,339 and 4,485,297 relating to an electrical resistance heater are incorporated herein by reference. The later technology is that adapted to the preferred embodiment of the present invention.

SUMMARY OF THE INVENTION

While not limited in use, the present invention provides a method for reducing mildew and mold growth in moist environments, on moist articles of clothing and other textiles as towels and wash clothes. It further provides a convenient method for drying articles of clothing. It combines the drying function with a means for reducing the local relative humidity.

It is an object of this invention to provide a means for drying sensitive articles of clothing and reducing the opportunity for growth of mold and mildew.

It is further an object of this invention to provide a safe, low heat dispersed source of drying.

Another object of this invention is to provide a flexible configuration for hanging and use in small spaces.

A further objective is to provide a low cost means of production.

These objectives are accomplished through a combination of the following. In its vertical mode the stand is of sufficient size to accommodate bath towels or regular sized sweaters draped over it. The stand is comprised of relatively large warming surfaces. In the hanging mode, the device may be suspended from an existing towel bar. In the horizontal mode, the device may be used to dry sweaters and the like without them stretching during the process.

DETAILED DESCRIPTION

Figure 1:
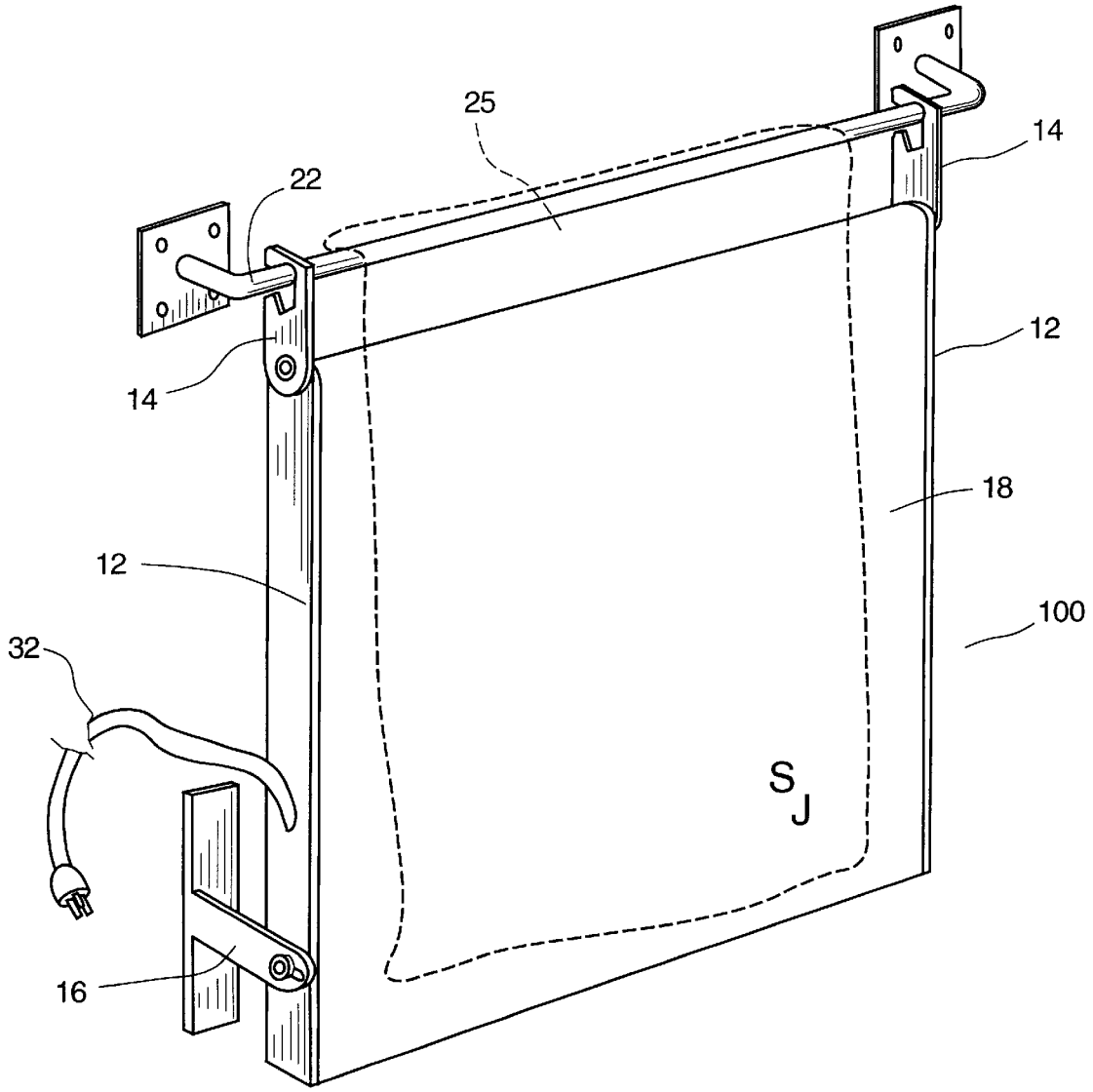
FIG. 1 is a perspective view of the drying frame in the vertical hanging mode.
Figure 7:
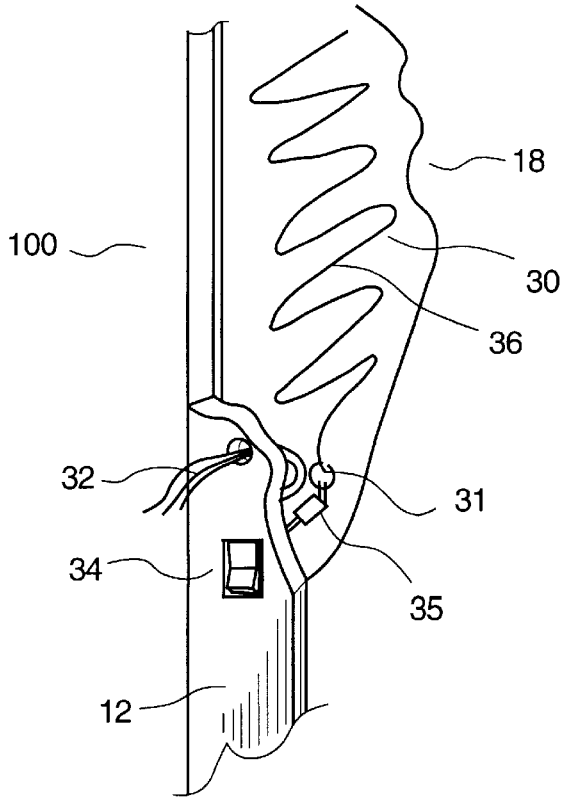
FIG. 7 is a cut-away view showing the heating element.

Referring to FIG. 1, drying rack 100 is comprised of two side supports 12 and a heat conducting cover sheet 18 which forms a housing for internal heating elements 30 (see FIG. 7 for cut-away view). The side supports 12 provide a structure to which hangers 14 and feet 16 are adjustably attached. An electrical cord 32 provides the means for connecting the internal heating elements to a power source. While a switch is not shown, an optional configuration would be to provide an on-off switch mounted on one of the side supports 12. The device is shown supporting a towel 25 but could be any number of textile articles including diapers, lingerie or other items of clothing. Hooks 14 are seen extended in this view and being attached to the horizontal bar of a towel bar 22. Hooks could be modified to attach directly to the wall. The feet 16 are seen parallel to the wall in this mode to prevent the frame from hitting the wall while adding or removing the article to be dried. In this configuration the feet 16 are most out of the way as well.

Figure 2:
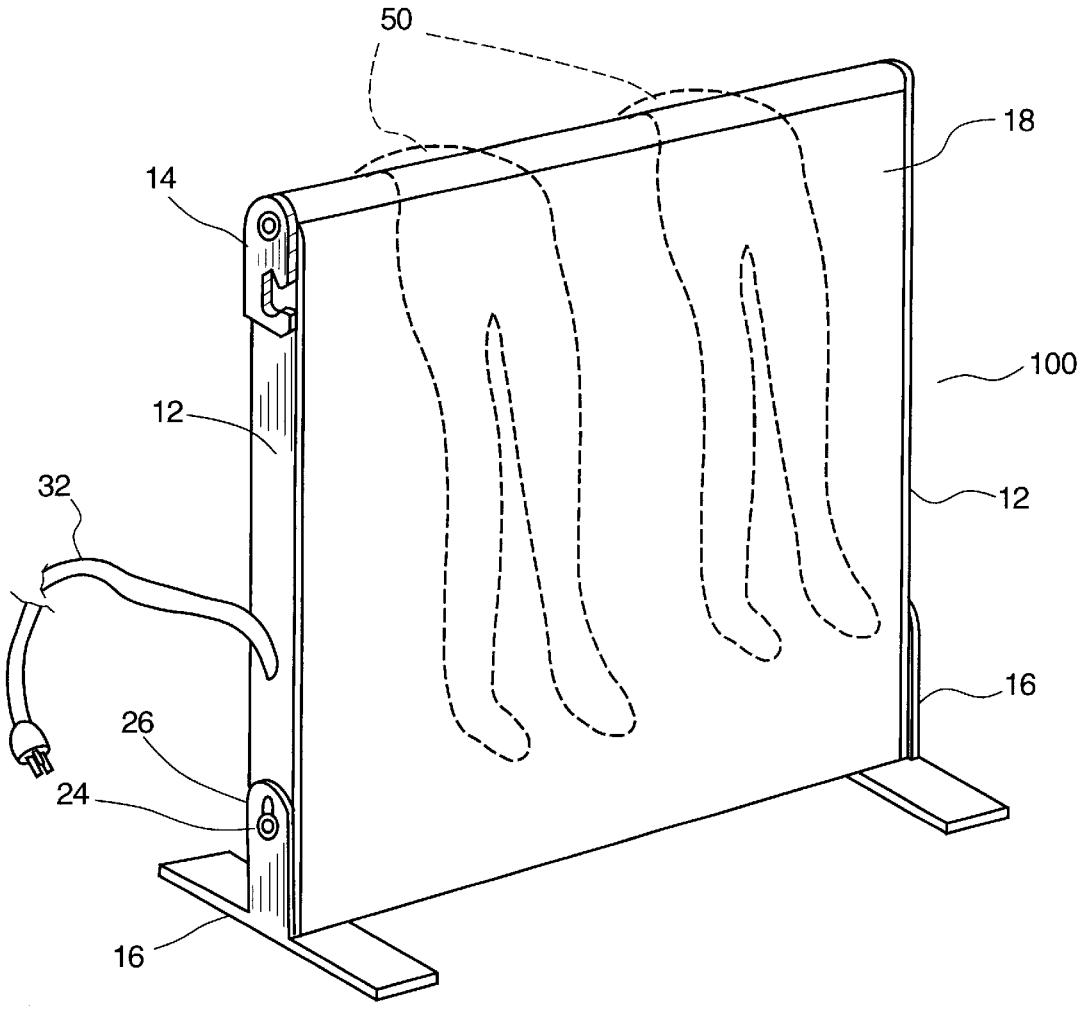
FIG. 2 is a perspective view of the drying rack in the stand-alone mode.

FIG. 2 is a perspective view of the drying rack in the stand-alone mode. Drying rack 100 is comprised of two side supports 12 and a heat conducting cover sheet 18 which forms a housing for internal heating elements 30 (see FIG. 7 for cut-away view). The side supports 12 provide a structure to which hangers 14 and feet 16 are adjustably attached. An electrical cord 32 provides the means for connecting the internal heating elements to a power source. While a switch is not shown, an optional configuration would be to provide an on-off switch mounted on one of the side supports 12. Hooks 14 are seen retracted in this view. The hooks can be made to be a slim profile as detailed in FIG. 6 and can be made to have position detents. An alternative is to make the hooks integral with and in line with the side supports. The feet 16 are seen perpendicular to the wall in this mode to hold the frame in a vertical position. The foot is slotted so that it can be repositioned and secured tight to the bottom of the side support 12 using a knob which tightens the foot "T" part 26 to the side support 12 by means of a bolt which inserts into a threaded piece on the inside surface of side support 12. See FIG. 4 and FIG. 6 for greater details. Other feet securing means should be evident to those knowledgable in mechanical design.

Cover sheet 18 in the preferred embodiment is made of a single piece of aluminum sheet of from 16–20 inches wide by 48 inches long draped over the side supports. In one embodiment, the side supports are made of a hard wood and slotted to receive the sheet which is then nailed, screwed or tacked to the wood. The thin strip with nails may then be covered with a thin laminate such as an adhesive backed strip to simulate the wood grain. In another version, the side supports may be of plastic and the covering sheet may also be of a plastic such as a polysulfone or polytetrafluoroethylene (Teflon brand) which conducts heat and withstands elevated temperatures. For the plastic version, components of the frame may be cemented or heat fused together. Illustrated is another use of the dryer; namely, for drying nylons or leotards 50.

Figure 3:
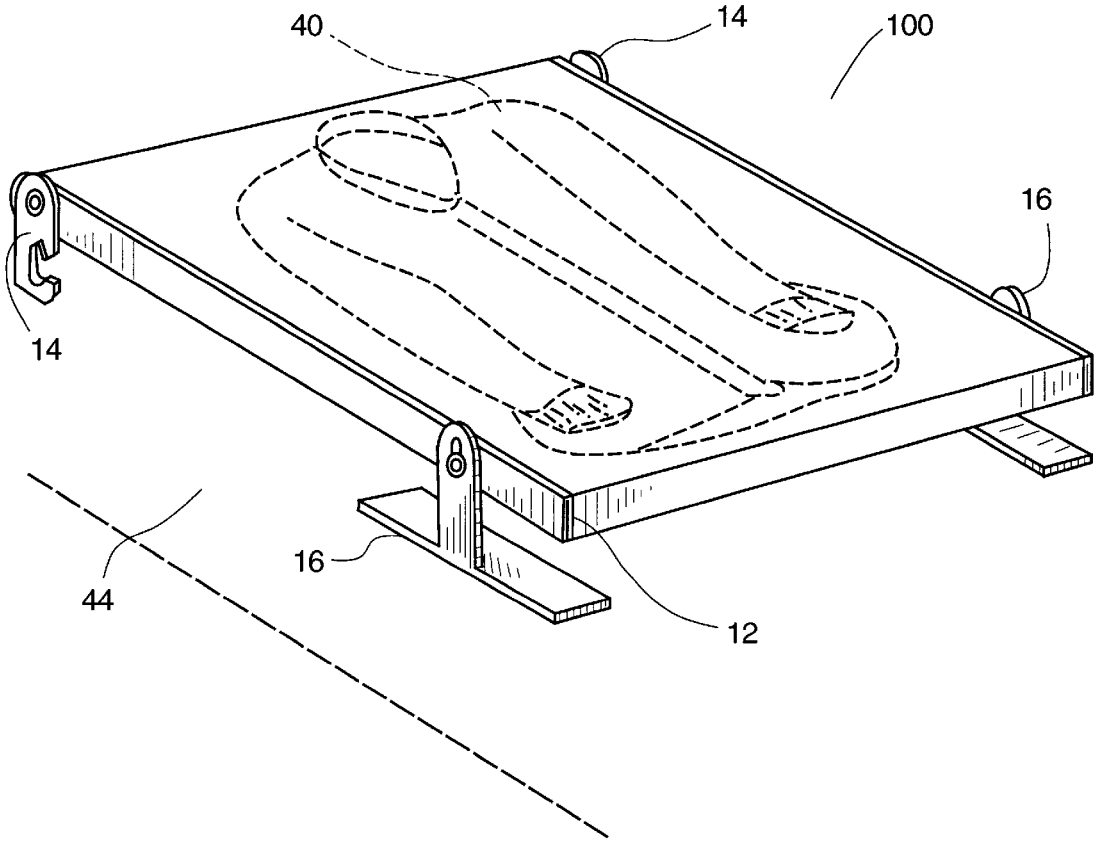
FIG. 3 is a perspective view of the drying rack in the horizontal mode.

FIG. 3 is a perspective view of the drying rack 100 in the horizontal mode setting on a surface 44 such as a counter top or table. An end of side support 12 is seen. Hook 14 is seen positioned at right angles in this view to elevate the frame above a surface and in fact to provide a downward slope to ease draining. Foot 16 is also seen positioned at right angles to the frame. Providing an air space between the surface 44 and the rack 100 prevents heat from building up on the surface. An article of clothing 40 is illustrated in this figure. In the vertical mode an article such as a towel could be exposed to both sides of the frame. In the present instance heavy sweaters are best dried in a horizontal position so they do not become stretched or misshapened. The size of the heating surface for sweaters is best in the range of at least 16 inches wide and 24 inches long.

Figure 4A:
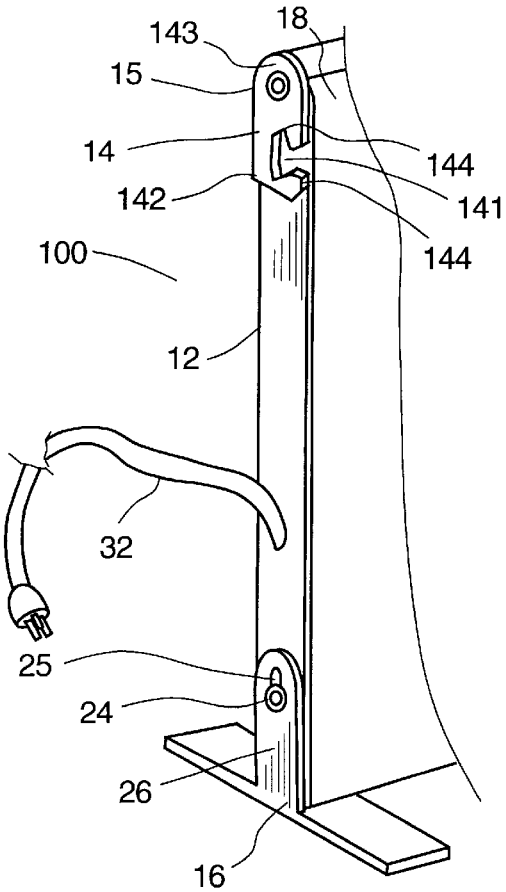
FIGS. 4*a* and 4*b* are details of the foot and hangers in two different positions.
Figure 4B:
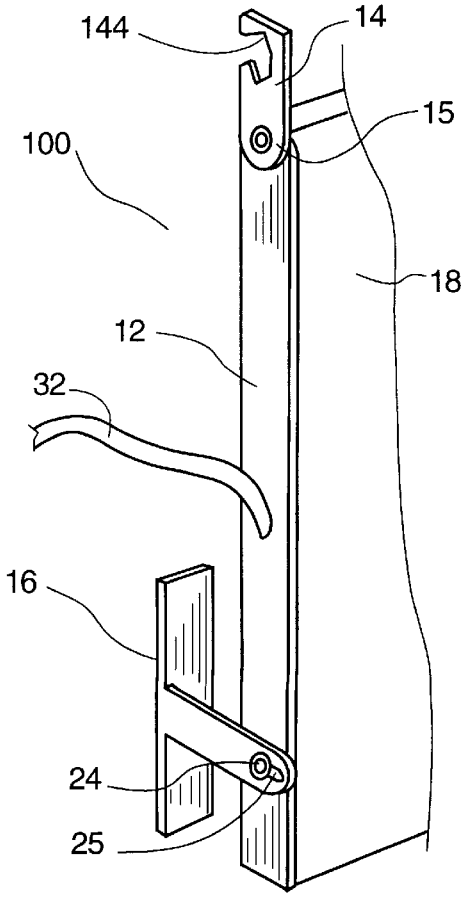
Figure 6A:
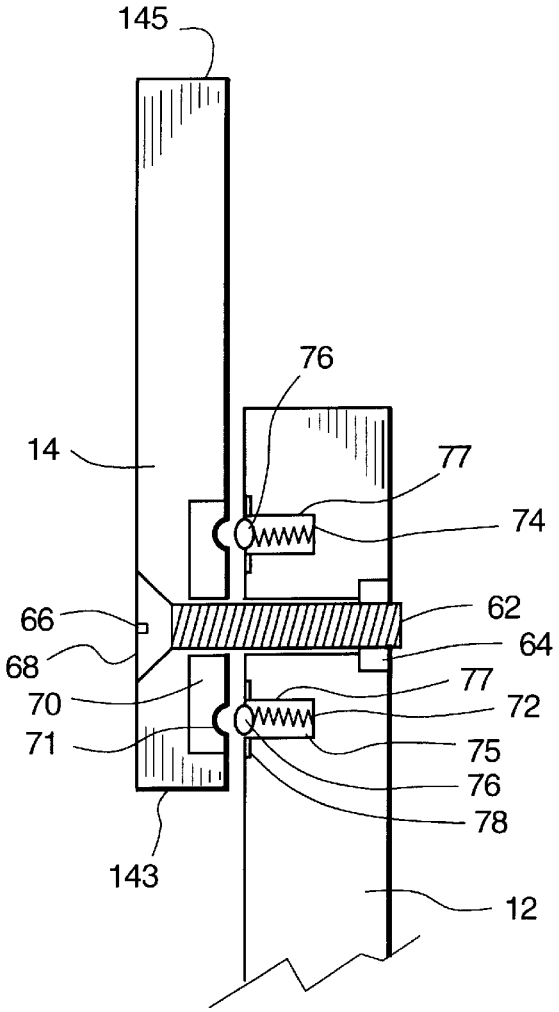
FIGS. 6*a*, 6*b*, and 6*c* show plan and cross section details of hanger and foot parts.
Figure 6B:
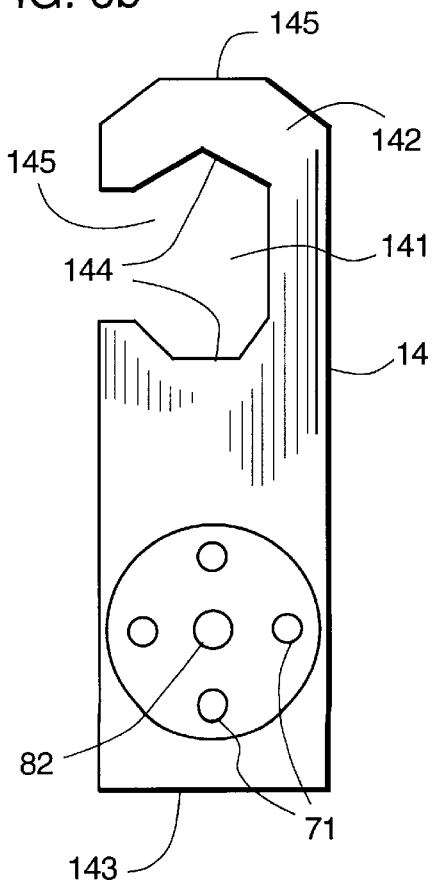

FIGS. 4*a* and 4*b* provide greater detail in perspective of the foot and hangers in two different positions. In FIG. 4*a* the hook 14 is folded along side support 12 in a retracted state. The hook 14 has an end portion comprised of the hook shaped half 142 and the mounting half 143. The hook shaped half 142 has an opening 141 which has extrema 144 which are at the center-line for the side supports 12. The mounting half 143 has a pivot member (hidden from view) around which the hook can rotate. In the embodiment shown the pivot member is covered by a tightening knob 15. This may be similar to the knob 24 used for the feet 16. On the other hand, it may be as depicted in FIG. 6*a* and 6*b* which has built-in spring-forced roller mating with a positioning detent.

The feet 16 are seen perpendicular to the wall in this mode to hold the frame in a vertical position. The foot has a slot 25 in the upright portion 26 so that it can be repositioned and secured tightly to the bottom of the side support 12 using a knob which tightens the foot "T" part 26 to the side support 12 by means of a bolt which inserts into a threaded piece on the inside surface of side support 12. See FIG. 6*c* for greater details and a cross section view.

FIG. 4*b* shows the hook 14 in its extended position parallel to side support 12. It is clear from this view that the extrema 144 of the inner portion 141 of hook 14 needs to be at the center-line for the side supports 12 in order for the device to hang in a pleasing vertical line. In the embodiment shown, the hook 14 is fastened into position by a tightening knob 15 which could be a flush mounted slotted bolt 62 as shown in cross section in FIG. 6*a*.

The feet 16 are seen parallel to the wall in this mode to keep them out of the way and to prevent the heated portions of the frame from banging into the wall. The foot has a slot 25 in the upright portion 26 so that it can be repositioned and secured tightly to the bottom of the side support 12 using a knob 24 which tightens the foot "T" part 26 to the side support 12 by means of a bolt which inserts into a threaded piece on the inside surface of side support 12. See FIG. 6*c* for greater details and a cross section view.

Figure 5:
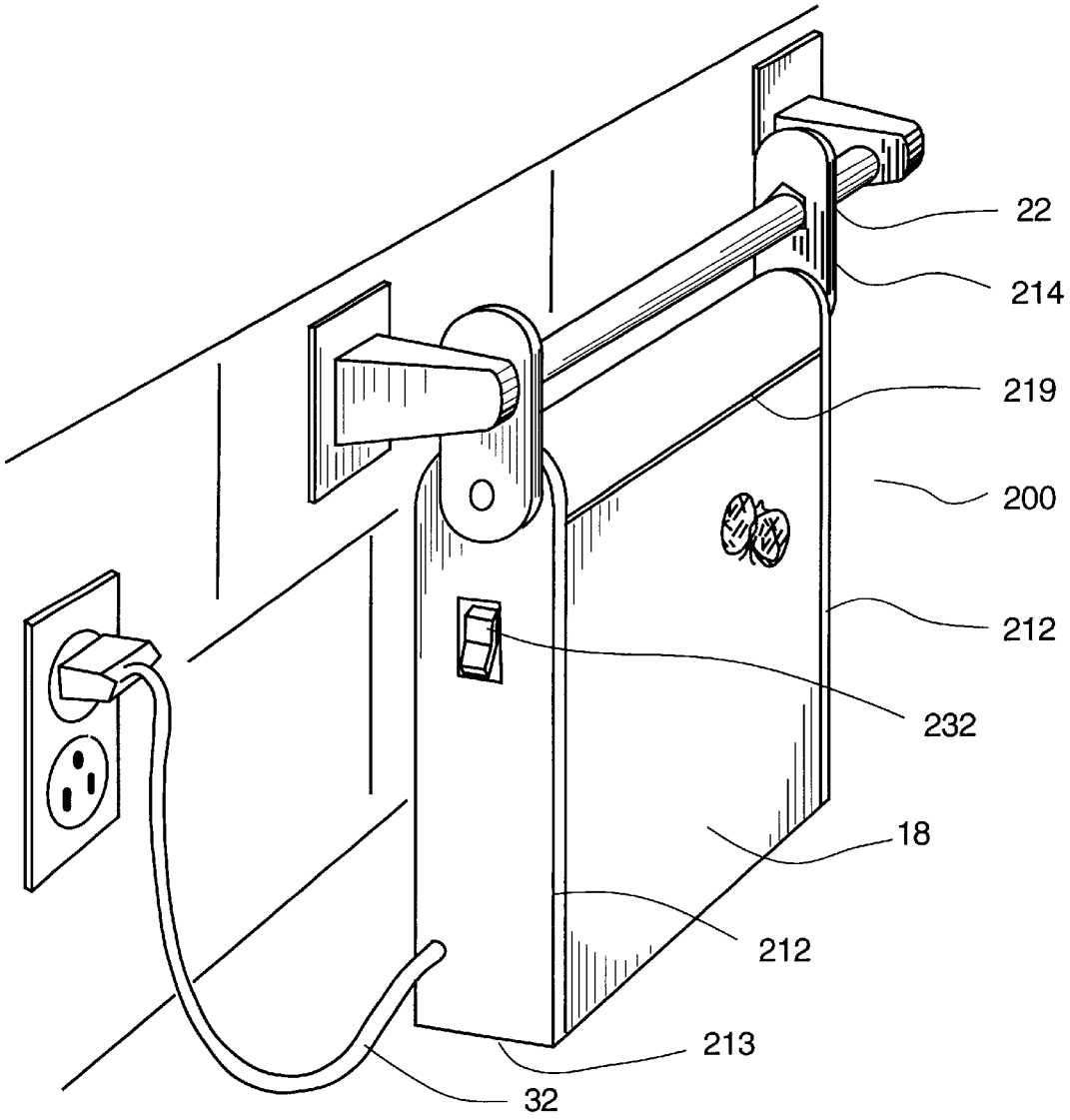
FIG. 5 is a perspective view of the drying frame used for small items.

FIG. 5 is a perspective view of a drying frame 200 used for small items such as lingerie, baby clothes, and the like. It has two side supports 212, a drying surface 18 and two hooks 214 for hanging over a towel bar 22. While not shown, the device could be constructed without hooks and placed directly on the floor or counter. The bottom 213 of the side supports 212 is made wide enough in this design to serve as feet. A seam 219 or transition between materials or components is indicated. While it is preferred that the cover 18 is a single piece that wraps over the top and down both front and back sides, it is possible for manufacturing considerations that a molded curved piece be placed at the top and straight flat sheets form the front and back. The junction at seam 219 should be water tight so moisture from drying objects does not leak inside to heater elements and electrical contacts. In this configuration, it is anticipated that an electrical switch 232 will be provided. As in all of the designs, a thermal protection cut-out element and a ground fault detector may be provided for safety reasons given typical bathroom environments.

Figure 6C:
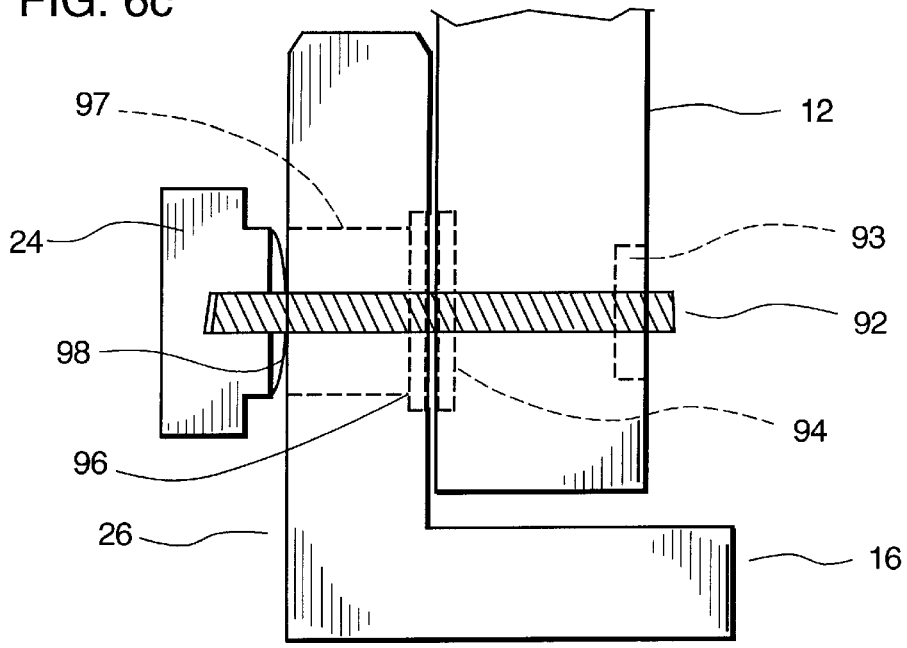

FIGS. 6*a*–6*c* show plan and cross section details of hanger and foot parts for device 100. FIG. 6*a* is a cross-sectional view of the hanger 14 affixed to the side support 12. Bolt 62 has a slotted 66 counter-sunk head 68 and an embedded nut 64 on the inside. While the nut would not have to be embedded, it is indicated this way to secure it so it does not turn when tightening the bolt from the outside. One alternative would be to thread the side support 12 directly. Bolt 62 serves as a pivot point for the hook 14. In order to provide a convenient means of positioning the hook in either the extended mode, the retracted mode, or the alternate foot mode, detents 71 are built into the hook 14 or provided by an attached insert 70 as indicated. These detents 71 coincide with one 72 or more 74 spring loaded positioning devices comprised of mating balls 76, a retainer flange 78, a spring 75 and spring housing 77.

FIG. 6*b* provides a plan inside view of hook 14. As seen in FIG. 6*b*, the detents 71 are located at 90 degrees from one another to provide stops at the various positions. A hole 82 for the bolt 62 is indicated. Another feature of hook 14 is indicated at the top 145 of the hook; namely, a section which is relatively flat so that it can make good contact with a surface when it is used in the horizontal position as a second set of feet. Obviously this end could be rounded as well but preferably of a large radius of curvature.

While inner sections 141 of the hook are indicated as having linear segments, these could be rounded. The critical part is to have extrema which are greater than the opening 145 so the hook does not easily slip off the towel bar.

FIG. 6*c* shows a cross section of the foot part 26 as it is attached to the side support 12. The foot part 26 is comprised of two orthogonal sections. Foot part 16 sits on the floor or other support surface and is firmly positioned against the end of side support 12 when the drying rack is in the vertical position. It is held in place by means of bolt 92 having an inside nut 93 and outside knob 24. Interspered are washers 94 and/or compression springs 96 and 98 to provide both wear surfaces and frictional holding.

FIG. 7 is a cut-away view showing the heating element 30 and connections 31 to an optional thermal cut-out device 35, an on-off switch 34 and power cord 32. The preferred heating element 30 is a thin flexible laminate sheet comprised of a pattern of conducting threads 36 throughout the inside of the laminate. The outer sheets are electrical insulators. The heat output is on the order of a 2–20 watts per square foot. A heating element that meets these general requirements is produced by Flexwatt Corporation and covered under Grise's U.S. Pat. Nos. 4,656,339 and 4,485,297 and is being sold for applications in buildings to prevent freezing damage. Obviously, there are other heating elements which would be suitable for this application as well including conventional resistive heating elements. Examples of other heating elements are: plate heaters, coil heaters, etched foil, ceramic, quartz, glass sealed filaments, tungsten halogen and the like. By and large most heating elements used in consumer items are of medium to high wattage having wattage ratings of from over 100 to 1200 watts. By contrast the present invention uses low wattage elements producing substantially under 100 watts to minimize safety concerns and overheating of potentially flammable materials (like lingerie).

Figure 8A:
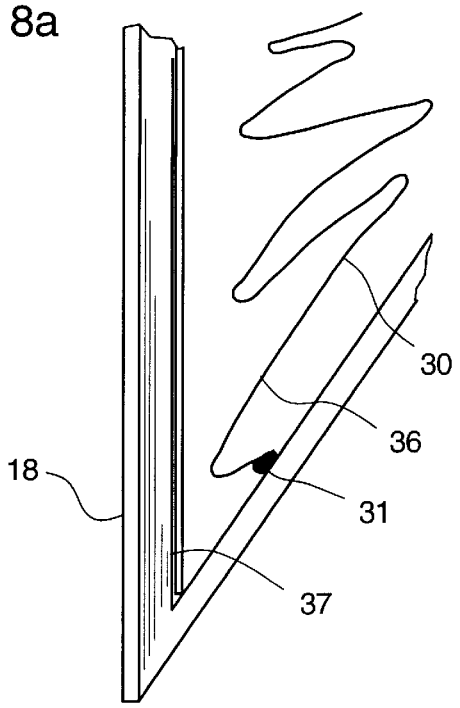
FIGS. 8*a* and 8*b* illustrate means for attaching heater coils to the frame.
Figure 8B:
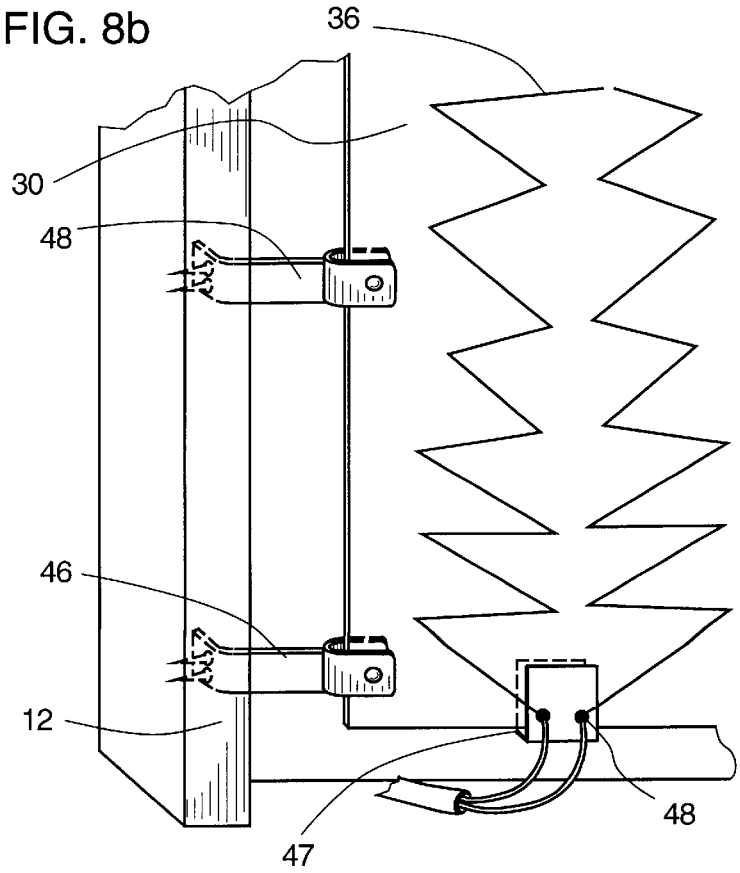

FIGS. 8*a* and 8*b* illustrate the preferred means for attaching the heating element 30 to frame/outer covering 18. In FIG. 8*a*, the flexible heating sheet 30 is adhered directly to the outer covering 18. This would be prior to final assembly. Selection of an adhesive layer 37 is important to assure mechanical stability as well as effective heat transfer without any risk of electrical leakage currents. The adhesive must also retain its desirable properties over a long period of time at elevated temperatures. Such adhesives are available from 3M and other manufacturers.

In FIG. 8*b*, an alternative means for attaching the heating element 30 to the frame is illustrated in this perspective view with one side removed to reveal the underlying heating element. This method is comprised of multiple clips 46 secured to the side supports 12 and extending out to grip the sheet of heating material 30. At the bottom is shown a special clip 47 which grips the sheet 30 and makes electrical contact with the internal resistive elements and in turn provides terminal posts 48 for attaching to external circuits.

Figure 9A:
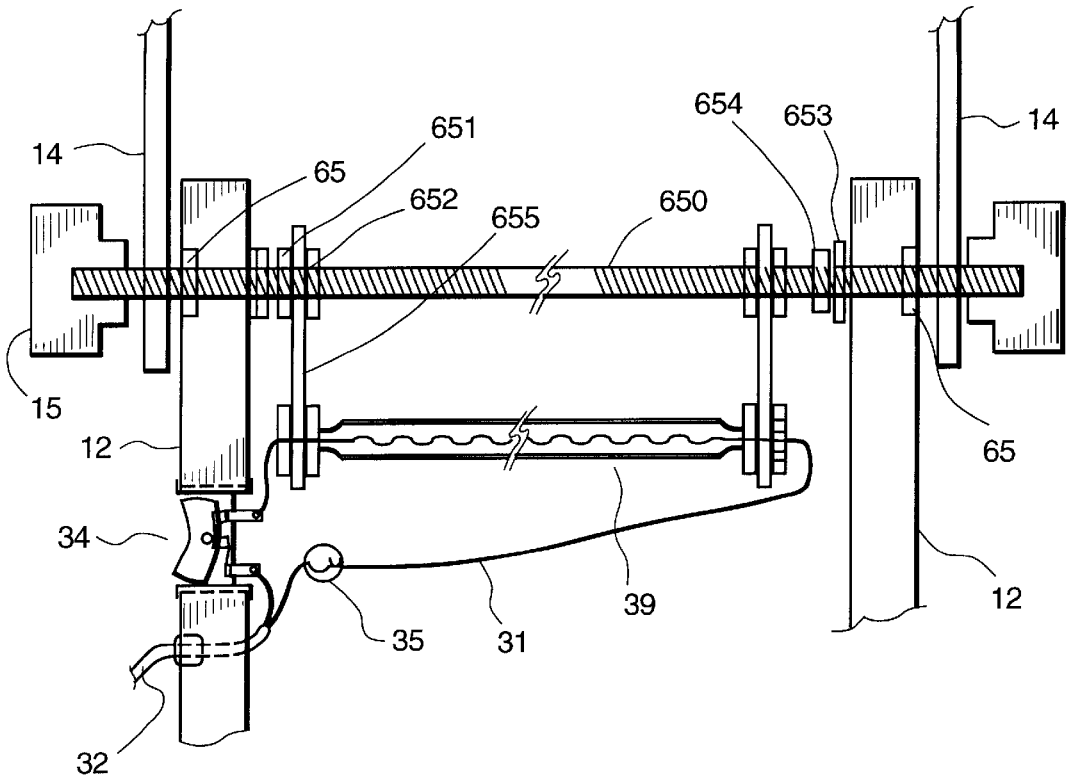
FIGS. 9*a* and 9*b* illustrate an alternate type heating element and means for assembling the device.

In FIG. 9*a*, an alternative heating element 39 is shown in side cut away view along with a means for attaching it and a means for assembling the unit. A cut-away section shows a resistive tubular heating element 39 and connections 31 to an optional thermal cut-out device 35, an on-off switch 34 and power cord 32. The heating element 39 is suspended by brackets 655 from a threaded bar 650 which also serves to hold the side supports 12 at a fixed distance (set by the position of washers 653 and nuts 654) and using nuts 65 the side supports 12 can be drawn tight to the sheet metal covering (18 in FIGS. 4 and others). The on-off switch 34 may be equipped with a light which turns on when the heater is on as an added safety feature.

Figure 9B:
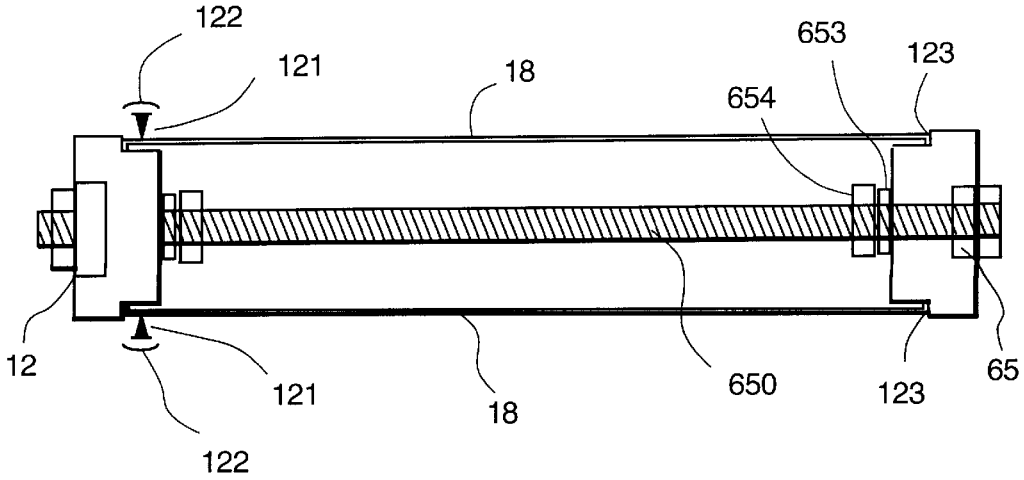

FIG. 9*b* shows an end view and two means of securing the outer covering 18 (plastic or metal sheet) to the side supports 12. On the left side is illustrated an attachment using tacks 121 which then may be covered with a strip 122 such as a simulated wood laminate. On the right side an alternative method is shown. A groove or undercut 123 is made in the side support 12 to hold the sheet covering in place while the nuts 65 are tightened down. The washer 653 and nut 654 are in place to hold the side supports apart until the covering can be applied and to take some strain off the cover sheet so it will not buckle or bend as readily. This is especially important when the more fragile heating element 39 is used.

Figure 10A:
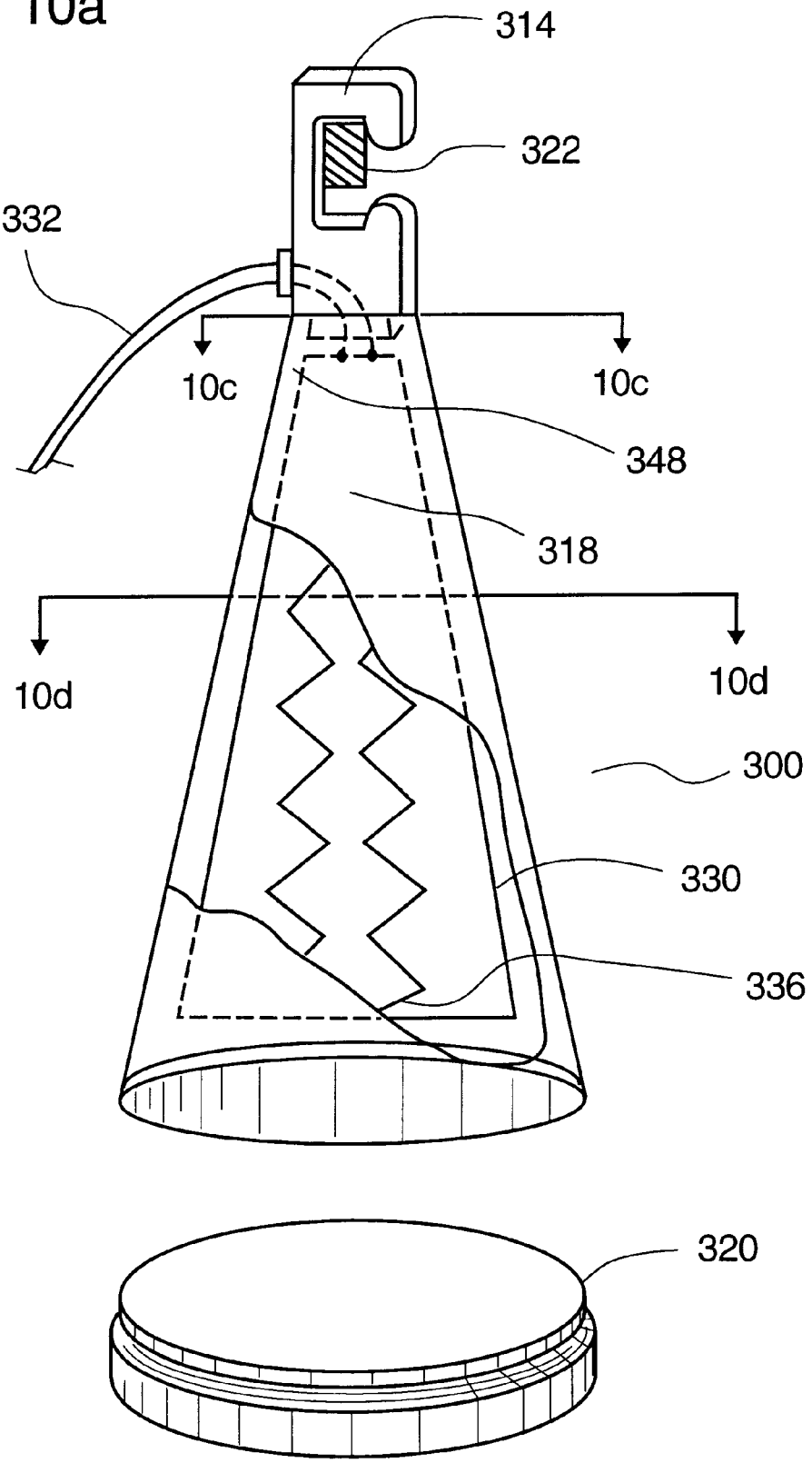
FIGS. 10*a* and 10*b* along with Sections A–A' and B–B' illustrate an alternate configuration for hanging a heating and drying device from a single point (as on the back of a door).
Figure 10B:
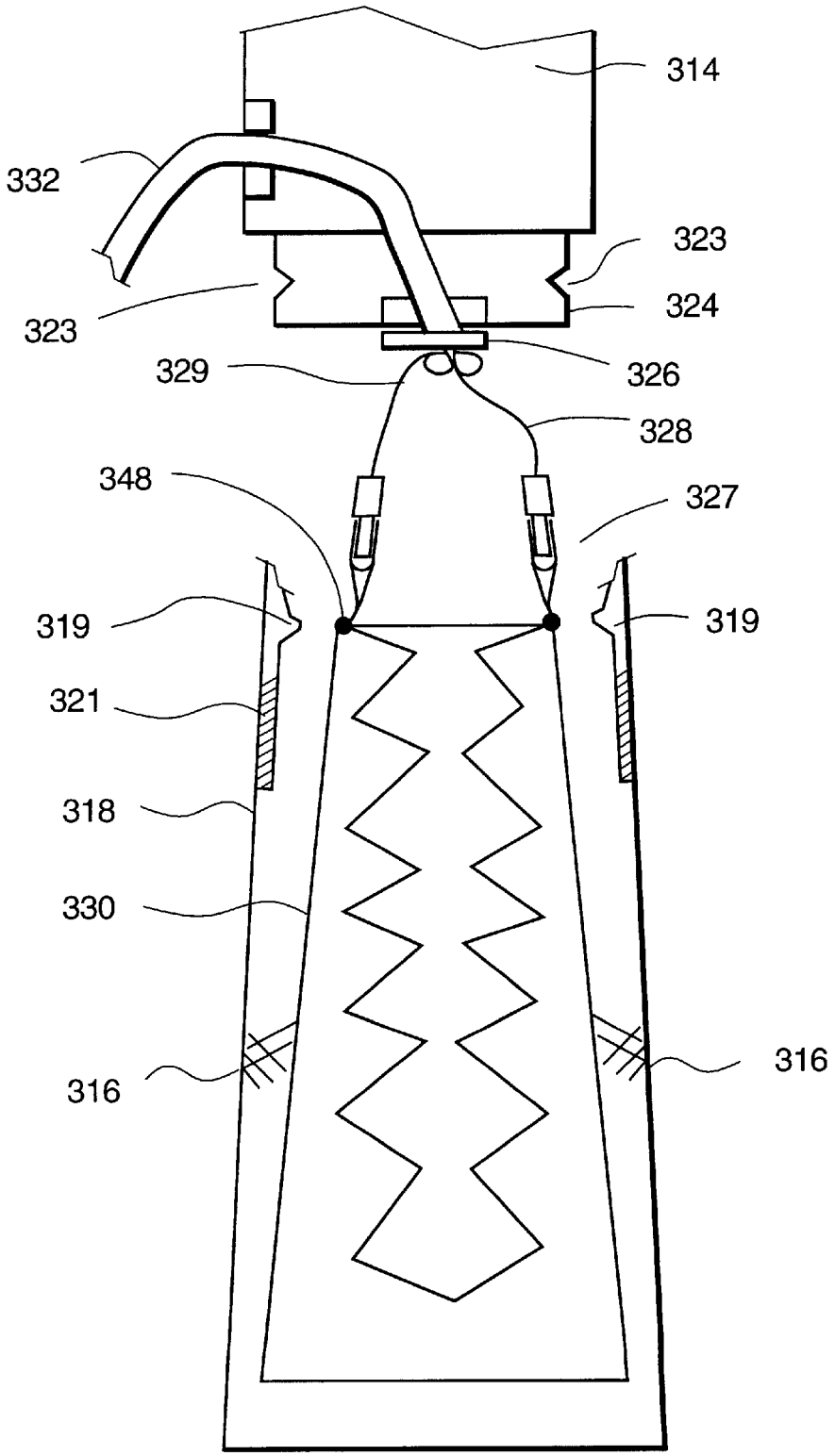

FIGS. 10*a*–10*c* show another embodiment of a fabric dryer/warmer 300. In this configuration the dryer/warmer may be hung from a single point 322 (as on the back of a door). In FIG. 10*a* device 300 comprises an outer covering 318, a bottom end piece 320 and a mounting hook 314 top piece. The top piece is further comprised of an opening which is sufficiently wide to fit over a towel hook as on the back of a door. Towel bars range in cross sectional size from 0.25 inch to 1.25 inches (6–32 mm). The device is also comprised of a heating element 330 in flexible sheet form having inner conductive threads 336 which give off heat when energized from conventional household voltage/current via power cord 332 which is connected via contact points 348. Sectional views B–B' and A–A' are also shown. In Section A–A' there is illustrated a bonding between the outer sheet and the inner heating sheet 330. In section B–B' is illustrated the position of the opening for the power cord.

In FIG. 10*b* greater details are provided for the means of assembly and attachment of parts. Outer covering 318 is further comprised of a means for securing to the mounting hook 314 top piece. The means illustrated is two spring clips 319 attached by cement, rivets, welding or other means to the top of the outer covering 318. The clips engage in grooves in narrower portion 324 of hook 314. A grommet 326 is also in this narrow part 324 of the hook for strain release for the entering power cord 332. The two to three conductor cord is shown to be divided and tied in an Underwriter's knot 329 before having a treated tip 328 for attachment to heater contact points 348. Treated tips 328 may be in the form of metal crimp connectors that mate with crimp connectors 327 of the opposite gender which are attached to leads connected to the heater element 330 at points of contact 348. Alternatively connections can be soldered.

Also shown is a partial mechanical/thermal connection between the heating element 330 and the outer cover 318 at points 316. While this is not necessary, it is preferred to give better mechanical stability and better heat transfer. The material connecting the outer covering 318 and the inner heating element 330 should be of a thermal conducting type.

What is claimed is:

1. A device for warming and drying textiles comprising:

a heating element;

a support frame;

means for standing said frame on a horizontal surface; and, means for hanging said frame from a vertical surface.

2. The device of claim 1 further comprising:

means for holding said frame out from said vertical surface.

3. A device for warming and drying textiles comprising:

a heating element;

a support frame;

means for standing said frame on a horizontal surface; and means for hanging said frame from a vertical surface wherein said means of standing further comprises:

a means for supporting said frame horizontally on said horizontal surface; and a means for supporting said frame vertically on said horizontal surface.

4. The device of claim 1 wherein said means for hanging said frame from a vertical surface further comprises:

at least one hook.

5. The device of claim 4 wherein said at least one hook has an opening of at least 3.2 cm. to allow use on a towel bar.

6. The device of claim 5 wherein said opening has extrema centrally positioned.

7. The device of claim 4 wherein said hook is pivotally attached to said frame.

8. The device of claim 1 wherein said heating element has a sheet form.

9. The device of claim 8 wherein said heating element employs a thermally conductive adhesive to attach to a cover.

10. The device of claim 1 wherein said means for standing further comprises:

a pivotal foot.

11. The device claim 1 wherein said heating element further comprises a sheet formed of thin plastic laminated sheets covering an internal conducting web.

12. The device of claim 1 wherein said support frame further comprises a flat heated area of at least 16 inches wide and at least 200 square inches in area to lay out articles of clothing for drying.

13. The device of claim 1 further comprising:

two uniformly heated sides.

14. The device of claim 8 further comprising means for stabilizing mechanically, electrically and thermally said heating element under conditions of high humidity and moisture.

15. The device of claim 1 wherein said support frame is further comprised of a single continuous thermally conductive sheet that forms an envelope over said heating element.

16. The device of claim 1 wherein said heating element delivers electrical power in the range of 5 to 50 watts.

17. A device for warming and drying textiles comprising:

a low wattage heating element;

a support frame; and, a means for standing said frame on a horizontal surface.

18. The device of claim 4 wherein said hook is flat on top and pivotally attached to said frame.

19. The device of claim 1 wherein said heating element is sealed from water.

* * * * *